US010077658B2

(12) United States Patent
Candler

(10) Patent No.: US 10,077,658 B2
(45) Date of Patent: Sep. 18, 2018

(54) ROLLER BRACKET FOR TUNNEL FORMS

(71) Applicant: WORKER SAFETY INNOVATIONS, LLC, Honolulu, HI (US)

(72) Inventor: Lewis Dennis Candler, Honolulu, HI (US)

(73) Assignee: WORKER SAFETY INNOVATIONS, LLC, Honolulu, HI (US)

( * ) Notice: Subject to any disclaimer, the term of this patent is extended or adjusted under 35 U.S.C. 154(b) by 82 days.

(21) Appl. No.: 15/451,362

(22) Filed: Mar. 6, 2017

(65) Prior Publication Data

US 2017/0268337 A1 Sep. 21, 2017

Related U.S. Application Data

(60) Provisional application No. 62/310,653, filed on Mar. 18, 2016.

(51) Int. Cl.

| | |
|---|---|
| ***E21D 11/10*** | (2006.01) |
| ***E21D 11/40*** | (2006.01) |
| ***E02D 29/045*** | (2006.01) |
| ***E04G 11/26*** | (2006.01) |

(52) U.S. Cl.

CPC ..... *E21D 11/40* (2013.01); *E02D 29/045* (2013.01); *E21D 11/102* (2013.01); *E02D 2250/0023* (2013.01); *E02D 2300/002* (2013.01)

(58) Field of Classification Search

CPC ..... E21D 11/00; E21D 11/10; E21D 11/102; E21D 11/40; E02D 29/045; E04G 11/06; E04G 11/20; E04G 11/26; E04G 11/34; E04G 2011/067

USPC ..... 405/132, 134, 135, 141, 146, 150.1; 249/11, 13, 20, 22, 31, 109; 264/33, 34, 264/228, 651; 425/63

See application file for complete search history.

(56) References Cited

U.S. PATENT DOCUMENTS 1,565,845 A * 12/1925 Brynoldt ..... E04G 11/34 405/114
4,247,269 A * 1/1981 Bezhanov ..... B28B 1/084 425/224
4,253,810 A * 3/1981 Bezhanov ..... E04G 11/22 249/20

(Continued)

*Primary Examiner* — Benjamin F Fiorello
*Assistant Examiner* — Stacy N Lawson
(74) *Attorney, Agent, or Firm* — Martin E. Hsia; Keri Ann K. S. Krzykowski

(57) ABSTRACT

A roller bracket having a base, a raising and lowering mechanism, a platform, and horizontal and vertical rollers. The base is attached to the vertical face of a starter wall at a level to provide a desired height for a concrete ceiling. With the platform in the raised position, the bottom edge of a tunnel form is lowered between the vertical roller and the starter wall onto the horizontal rollers. A wedge is driven between the vertical roller and the tunnel form to seal the tunnel form against the starter wall. After concrete has been poured, retained by the seal, and cured to form the concrete walls and ceiling, the mechanism can lower the platform to strip the tunnel form from the tunnel. The tunnel form can then be rolled away on the horizontal rollers while being retained on the horizontal rollers by the vertical roller and the starter wall.

6 Claims, 7 Drawing Sheets

(56) References Cited

U.S. PATENT DOCUMENTS

| | | | | |
|---|---|---|---|---|
| 5,086,605 | A * | 2/1992 | Tzincoca | E04G 11/28 249/20 |
| 6,619,885 | B2 * | 9/2003 | Pertoldi | E04G 11/02 249/10 |
| 6,770,228 | B2 * | 8/2004 | Rock | E04G 11/28 249/19 |
| 7,004,737 | B2 * | 2/2006 | Russell | E04B 1/3404 425/63 |
| 2002/0166943 | A1 * | 11/2002 | Pertoldi | E04G 11/02 249/11 |

* cited by examiner

ROLLER BRACKET FOR TUNNEL FORMS

This application claims the priority of U.S. provisional patent application No. 62/310,653 filed on Mar. 18, 2016.

TECHNICAL FIELD

The present invention relates to improvements in using tunnel forms to create tunnel like structures (tunnels). After the tunnels are formed, walls can be installed across the tunnels to segment the tunnels into rooms; neighboring tunnels can form neighboring rooms; and the ceilings of tunnels can be the floors for additional tunnels and rooms above. Thus, tunnel forms can be used to construct multi-story buildings with multiple rooms very quickly.

BACKGROUND ART

Tunnel forms are used to quickly and simultaneously form integral walls, floors and ceilings for tunnels from poured concrete, thus saving time and construction costs.

Tunnel forms have vertical portions connected (at the top) to horizontal portions, and can have vertically extendable or telescoping legs or feet, and cross braces and supports (props), to retain their desired configuration and orientation when concrete is poured into the vertical portions and on to the horizontal portions.

In the abstract, the process for using tunnel forms is relatively simple. Tunnel forms (with their legs or feet in a vertically extended position) are placed on the floor on both sides of a previously created starter wall (sometimes called a curb or kicker). The vertical portions of the tunnel forms are then sealed against the vertical faces of the starter wall, so that the vertical portions of the tunnel forms are coplanar (aligned) with the vertical faces of the starter wall. In this manner, the vertical portions of the tunnel forms upwardly extend the vertical faces of the starter wall, which creates a confined space between the top of the starter wall and the vertical portions of the tunnel forms. Concrete is then poured into that confined space to form a concrete wall that extends the starter wall upwards to the top of the vertical portion of the tunnel forms, and more concrete is then poured (supported by the horizontal portion of the tunnel form) to integrally form a concrete ceiling with the concrete wall. After the poured concrete has cured (dried) enough to support its own weight, the tunnel forms are stripped (separated) from the concrete wall and ceiling, and the tunnel forms are removed and reused.

Before the concrete is poured, reinforcing bar, as well as wires, pipes and other utilities, can be placed in the spaces (for the walls, floors and ceilings) defined by the tunnel forms, to be buried in the concrete and thereby incorporated into the walls, floors and ceilings. "Block outs" can also be placed in the spaces (for the walls, floors and ceilings) defined by the tunnel forms, to block out concrete from desired areas in the walls, floors or ceilings, so as to form windows and doors and other penetrations through the walls, floors and ceilings.

Tunnel forms can either be full tunnel forms, having an inverted "U" cross section, or half tunnel forms, having an inverted "L" cross section (which can be used in adjacent pairs joined at the edges of their horizontal portions to form an inverted "U").

In actual practice, use of tunnel forms is labor intensive and therefore expensive. Conventional practice is to seal the tunnel forms against the vertical faces of the starter walls by inserting beams (usually wooden) that span the width of the tunnel being formed (between two adjacent starter walls) and then pounding those beams into place to span and forcibly spread or "smush" the vertical portions of the tunnel forms against the vertical faces of the adjacent starter walls to remove bows or wrinkles out of the tunnel form for accurate placement of block outs. To maintain this seal between the tunnel forms and the starter walls during pouring and curing of the poured cement, elongated tapered bolts ("taper ties") are inserted at intervals (usually plus or minus 4 feet) through preexisting holes in the tunnel forms, and secured and tightened by nuts. Conventionally, an upper and a lower row of taper ties may be used, with the lower row of taper ties being subjected to greater stress from the weight of the poured concrete, so that lower taper ties may be more likely to fail. If any of the lower taper ties fails, then they must be replaced before the concrete can be poured.

Concrete is then poured into the spaces defined by adjacent tunnel forms (whose vertical portions were sealed to be coplanar with the vertical faces of the starter wall) to simultaneously create concrete walls that extend the starter wall upwards, and also to form the ceiling, which will also form the next floor above. After the poured concrete is cured sufficiently to support its own weight, rollers are placed on the floor below the tunnel forms. Then, a crane is used to support the weight of the tunnel forms, and the extendable or telescoping legs or feet are retracted. The crane is then used to lower the tunnel forms (onto the rollers), to release or "strip" the tunnel forms from the ceiling and walls formed by the cured concrete. The tunnel forms are then rolled (on the rollers) out from underneath the newly formed concrete ceiling so that they can be picked up by the crane and used again.

The labor to seal the tunnel forms against the starter walls is expensive. Likewise, the labor to remove the tunnel forms is also expensive, because the rollers must be placed on the floor, then the crane must be used to support the weight of the tunnel forms while the extendable or telescoping legs or feet of the tunnel form are retracted and to lower the tunnel forms onto the rollers, and the tunnel forms then must be rolled over those rollers. The rollers may not be perfectly aligned, or may not remain aligned as the tunnel form is rolled, so that they may need to be re-aligned as the tunnel form is rolled. The rollers on the floor also may present a safety hazard for workers. Moreover, a crane must be used to lower the tunnel forms onto the rollers, which adds significantly to overall expense.

Further, the height of the concrete walls being formed is conventionally controlled by using tunnel forms of different heights, or by raising tunnel forms from the floor by extending the extendable or telescoping legs or feet that rest on the floor. However, providing tunnel forms of multiple different heights is prohibitively expensive, because of the number of different tunnel forms that will need to be maintained. Providing extendable or telescoping legs or feet that extend sufficiently to create a range of heights increases the cost of the tunnel forms substantially, because tunnel forms are very heavy, as they must be strong enough to support the weight of concrete being poured for walls and ceilings/floors.

The following patents are considered to be background art to the present invention.

U.S. Pat. No. 6,619,885 to Pertoldi, incorporated herein by reference, discloses a tunnel form having two vertical forming walls joined by a horizontal wall, with means at the base with an amplitude of adjustment on the order of ten to twenty centimeters for adjusting the height of a top edge of the tunnel form relative to a reference surface, and means for supporting the tunnel form when the tunnel form is stripped from poured concrete, where the height adjusting means are supported by props that are slide mounted in a sleeve attached to the base of the tunnel form. A starter wall (curb or kicker) of one thousand five hundred millimeters is disclosed. The height of the walls is determined by the supports placed on the reference surface. The tunnel forms are rolled away using rollers mounted on the reference surface.

U.S. patent application Ser. No. 09/853,723 to Pertoldi, published as U.S. 2002/0166943, incorporated herein by reference, discloses a tunnel form with three forming walls, where the base and lateral edges of the form have a flat bar, and the joining and aligning means for adjacent forms are attached to the forming walls.

DISCLOSURE OF THE INVENTION

The invention is directed to a device and process that solves one or more of the problems due to limitations and disadvantages of the background art, and that also allows easier variation of the height of the wall being formed using tunnel forms.

The advantages of the invention include substantially reducing the labor necessary to: position tunnel forms; to seal tunnel forms against starter walls; to help secure tunnel forms during pouring and curing by relieving stress on the lower row of taper ties; to strip tunnel forms after curing without the use of a crane to lower the tunnel forms; and to easily and safely remove tunnel forms for re-use.

Additional features and advantages of the invention will be set forth in the description which follows, and in part will be apparent from the description, or may be learned by practice of the invention. The features of the invention will be realized and attained by the structure particularly pointed out in the written description and claims hereof, as well as the appended drawings.

To achieve these and other advantages according to the present invention, one preferred embodiment of the invention is a roller bracket for mounting on a starter wall that has a top, to rollably support a tunnel form having a bottom edge with a bottom edge thickness. The roller bracket has a base; a raising and lowering mechanism mounted to the base; a platform movably supported by the raising and lowering mechanism; a horizontal roller having an inner end and an outer end separated by more than the bottom edge thickness, rollably mounted on the platform; and a vertical roller perpendicular to the horizontal roller, rollably mounted on the platform outward from and above the outer end of the horizontal roller. When the base is attached to the starter wall so that the horizontal roller is horizontal and projects perpendicularly from the starter wall, with the near end next to the starter wall, and the vertical roller is vertical and above the horizontal roller, the bottom edge can be lowered between the vertical roller and the starter wall onto the horizontal roller, and the mechanism can lower the platform with respect to the base to lower the tunnel form supported by the horizontal roller. The tunnel form can be rollably supported by the horizontal roller with the lower edge retained on the horizontal roller by the vertical roller and the starter wall. The base can be attached to the starter wall at a desired level to create a concrete wall of a desired height. With the platform in a raised position but the bottom edge of the tunnel form rollably supported by the horizontal roller below the top of the starter wall, a wedge can be driven between the vertical roller and the tunnel form to seal the bottom edge of the tunnel form against the starter wall. After concrete has been poured between the tunnel form and the starter wall, retained by the seal, and cured to form the concrete wall above the starter wall, the mechanism can lower the platform from the raised position, to lower the horizontal roller and the tunnel form rollably supported by the horizontal roller. This strips the tunnel form from the concrete, while the tunnel form is still supported by the horizontal roller. After stripping, the tunnel form can be rolled away on the horizontal roller while the bottom edge is retained on the horizontal roller between the vertical roller and the cured concrete wall. The roller bracket also helps to relieve the stress on the lower row of taper ties.

In another embodiment of the invention, the platform is attached to a housing slidable within the base that has a mounting hole slot, and the frame has a mounting hole in a projection that projects through the slot when the housing is placed within the frame and supported by the mechanism, so that the projection through the slot limits the housing to moving vertically within the frame.

In another embodiment of the present invention, at least one of the rollers is at least two coaxial wheels.

In another embodiment of the present invention, the raising and lowering mechanism is a screw driven jack mounted in the base, attached to the platform.

In another embodiment, the present invention is a process for forming a concrete wall of a desired height using at least one tunnel form having a bottom edge with a bottom edge thickness, comprising: creating a starter wall having a top that is less than the desired height; attaching at least one roller bracket having a base, a raising and lowering mechanism mounted to the base, a platform movably supported by the raising and lowering mechanism, a horizontal roller having an inner end and an outer end separated by more than the bottom edge thickness, rollably mounted on the platform, and a vertical roller perpendicular to the horizontal roller, rollably mounted on the platform outward from the outer end of the horizontal roller; using the raising and lowering mechanism to raise the platform with respect to the base to a raised position; attaching the base of the roller bracket to the starter wall at a desired level to form a concrete wall of the desired height and so that the horizontal roller is horizontal and projects perpendicularly from the starter wall, with the near end next to the starter wall, and the vertical roller is vertical and above the horizontal roller; lowering the bottom edge between the vertical roller and the starter wall onto the horizontal roller, whereby the tunnel form is rollably supported on the horizontal roller with the lower edge retained on the horizontal roller by the vertical roller; driving a wedge between the vertical roller and the tunnel form to seal the bottom edge of the tunnel form against the starter wall; pouring concrete between the tunnel form and the starter wall, whereby the concrete is retained by the seal and forms the concrete wall of the desired height; curing the concrete wall; lowering the platform from the raised position using the raising and lowering mechanism, to lower the horizontal roller and the tunnel form, whereby the tunnel form is stripped from the concrete while being supported by the horizontal roller; and rolling the tunnel form away on the horizontal roller while the bottom edge is retained on the horizontal roller between the vertical roller and the cured concrete wall.

In still another embodiment, the present invention is a process for forming a concrete wall of a desired height using a tunnel form having a bottom edge with a bottom edge thickness, and a roller bracket having a base, a raising and lowering mechanism mounted to the base, a platform movably supported by the raising and lowering mechanism, a horizontal roller having an inner end and an outer end separated by more than the bottom edge thickness, rollably mounted on the platform, and a vertical roller perpendicular to the horizontal roller, rollably mounted on the platform outward from the outer end of the horizontal roller. This process comprises creating a starter wall having a top that is less than the desired height; using the raising and lowering mechanism to raise the platform with respect to the base to a raised position; attaching the base of the roller bracket to the starter wall at a desired level to form a concrete wall of the desired height and so that the horizontal roller is horizontal and projects perpendicularly from the starter wall, with the near end next to the starter wall, and the vertical roller is vertical and above the horizontal roller. The bottom edge is then lowered between the vertical roller and the starter wall onto the horizontal roller, so that the tunnel form is rollably supported on the horizontal roller with the lower edge retained on the horizontal roller by the vertical roller. A wedge is then driven between the vertical roller and the tunnel form to seal the bottom edge of the tunnel form against the starter wall. Concrete is then poured between the tunnel form and the starter wall, so that the concrete is retained by the seal and forms the concrete wall of the desired height. The concrete wall is then cured. Then the platform is lowered from the raised position using the raising and lowering mechanism, to lower the horizontal roller and the tunnel form, so that the tunnel form is stripped from the concrete while being supported by the horizontal roller. The tunnel form is then rolled away on the horizontal roller while the bottom edge is retained on the horizontal roller between the vertical roller and the cured concrete wall.

BRIEF DESCRIPTION OF DRAWINGS

The accompanying drawings, which are included to provide a further understanding of the invention and are incorporated into and constitute a part of this specification, illustrate certain embodiments of the invention and, together with the description, serve to illustrate the principles of the invention.

In the drawings.

BEST MODE FOR CARRYING OUT THE INVENTION

The presently preferred best mode for practicing the present invention is presently illustrated by way of example in FIGS. 1 to 7.

Figure 1:
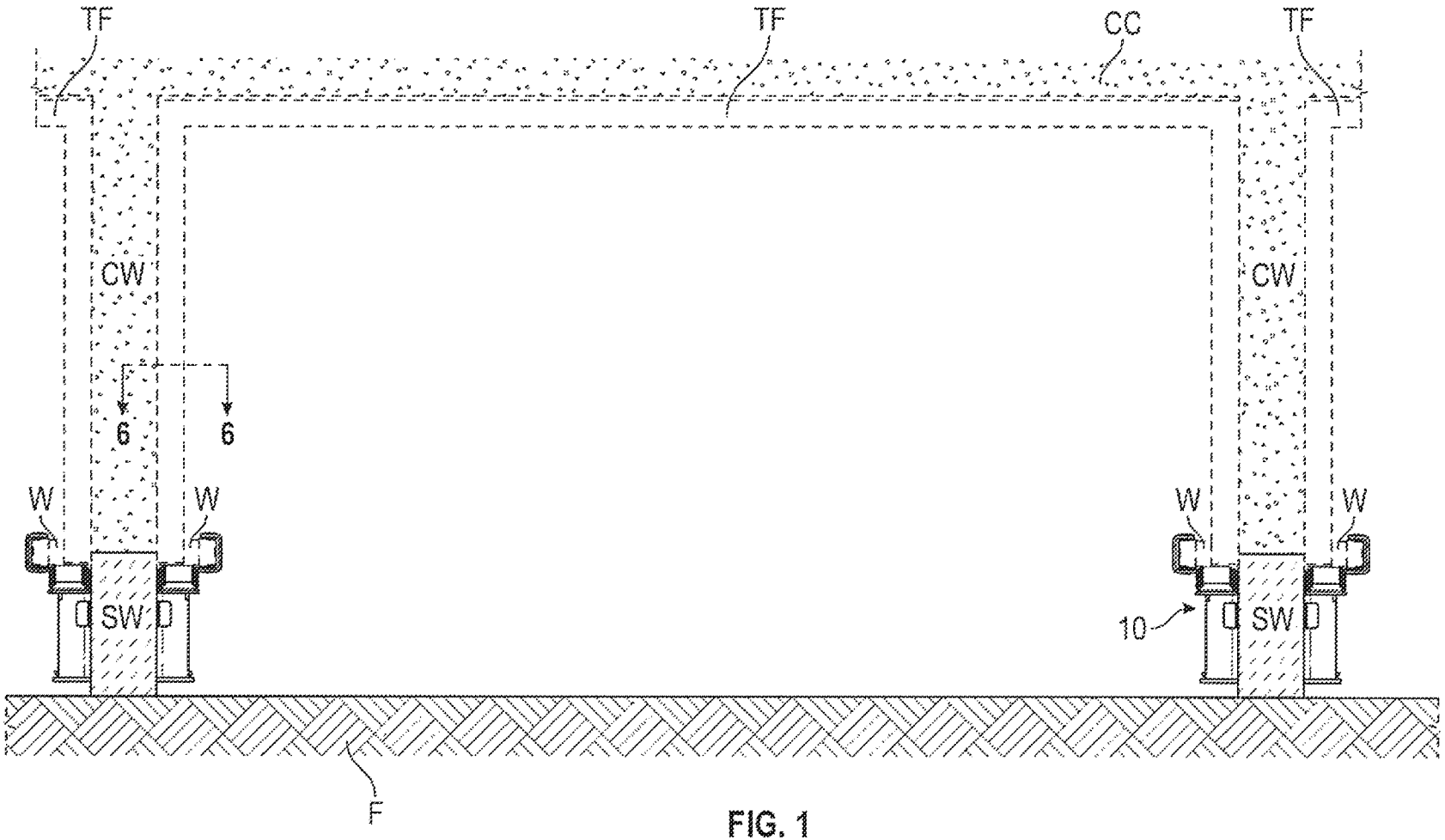
FIG. 1 is an end elevational view of the presently preferred embodiment of the roller bracket of the present invention, installed on starter walls to hold tunnel forms in place, just after the rollers have been lowered to strip the tunnel forms from the concrete walls and ceiling.

Referring to FIG. 1, shown is an end elevational view of the presently preferred embodiment of the roller bracket 10 of the present invention in the lowered configuration, installed on starter walls SW to hold tunnel forms TF in place. The concrete has already been poured and cured to form concrete walls CW and a concrete ceiling CC. The roller brackets 10 have been changed to the lowered configuration so that the tunnel forms TF have been removed or released ("stripped") from the concrete ceiling CC and concrete walls CW, as is shown by the very small gap between the concrete ceiling CC and the tunnel forms TF. Note that the roller brackets 10 were installed above the floor F, on the vertical faces of starter walls SW, and support the tunnel forms TF. For clarity, braces and supports for the tunnel forms TF have all been omitted. Figures illustrating those braces and supports are in the patents cited above.

Figure 2:
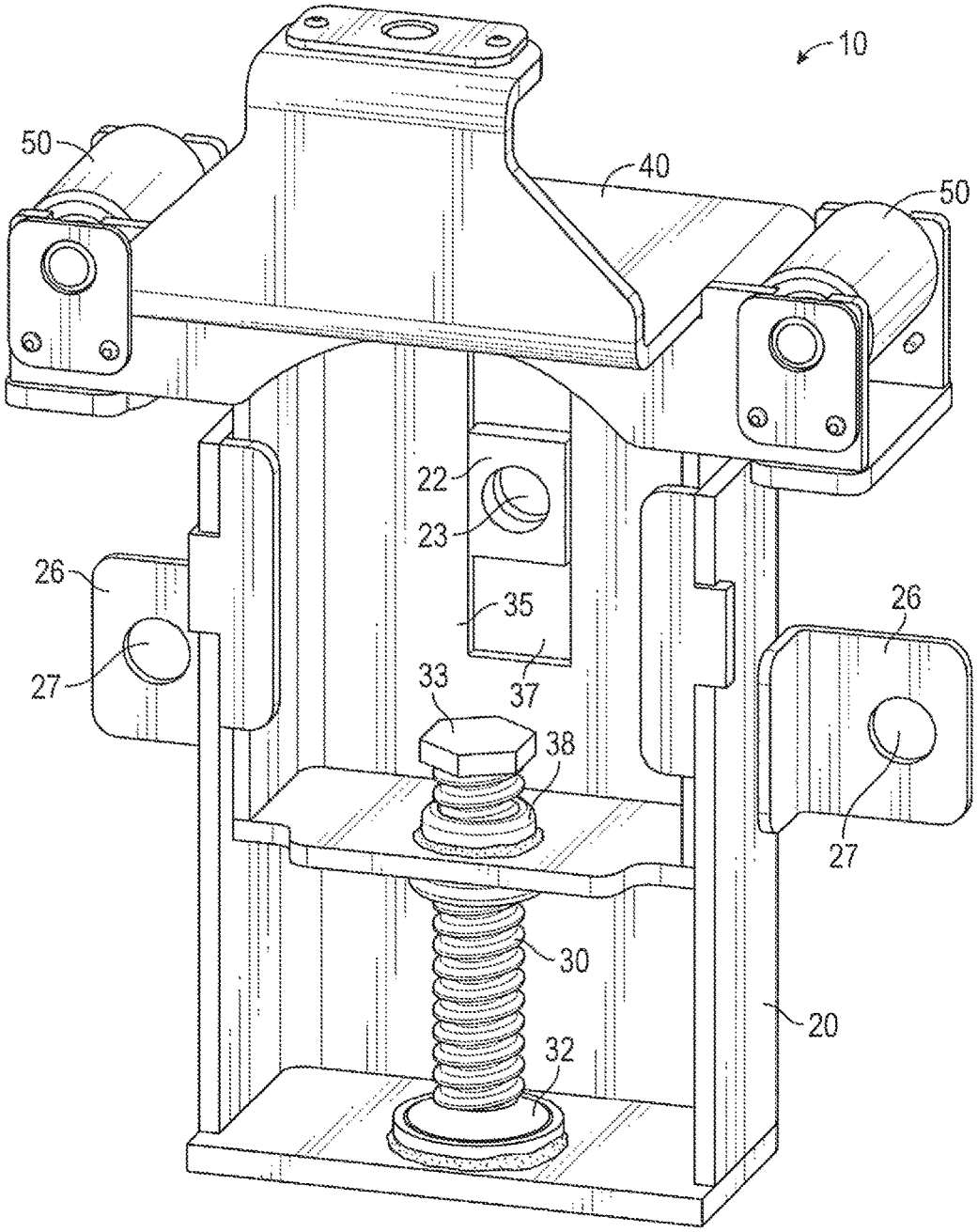
FIG. 2 is a perspective view from the upper rear right of the presently preferred embodiment of the roller bracket of the present invention in the raised position.

Referring to FIG. 2, shown is a perspective view from the upper rear right of the presently preferred embodiment of the roller bracket 10 of the present invention, which comprises a base 20, with a raising and lowering mechanism that includes a vertical bolt 30 having a hex head 33 rotatably mounted on a bearing 32 that is affixed to the base 20. The bolt 30 is engaged with a threaded collar 38 in movable carriage 35 to form a screw driven jack. Preferably the base 20 includes a projection 22 that has a primary mounting hole 23, and the projection 22 projects through a mounting hole slot 37 in the carriage 35, so that rotating the bolt 30 raises and lowers the carriage 35, which raises and lowers a platform 40. Horizontal rollers 50 are rollably mounted on the platform 40, with the near end and far end of the rollers separated enough to make the horizontal rollers 50 wide enough to receive the bottom edge of a tunnel form TF (see FIG. 7). Preferably also the base 20 is provided with supplemental projections 26 having supplemental mounting holes 27.

Figure 3:
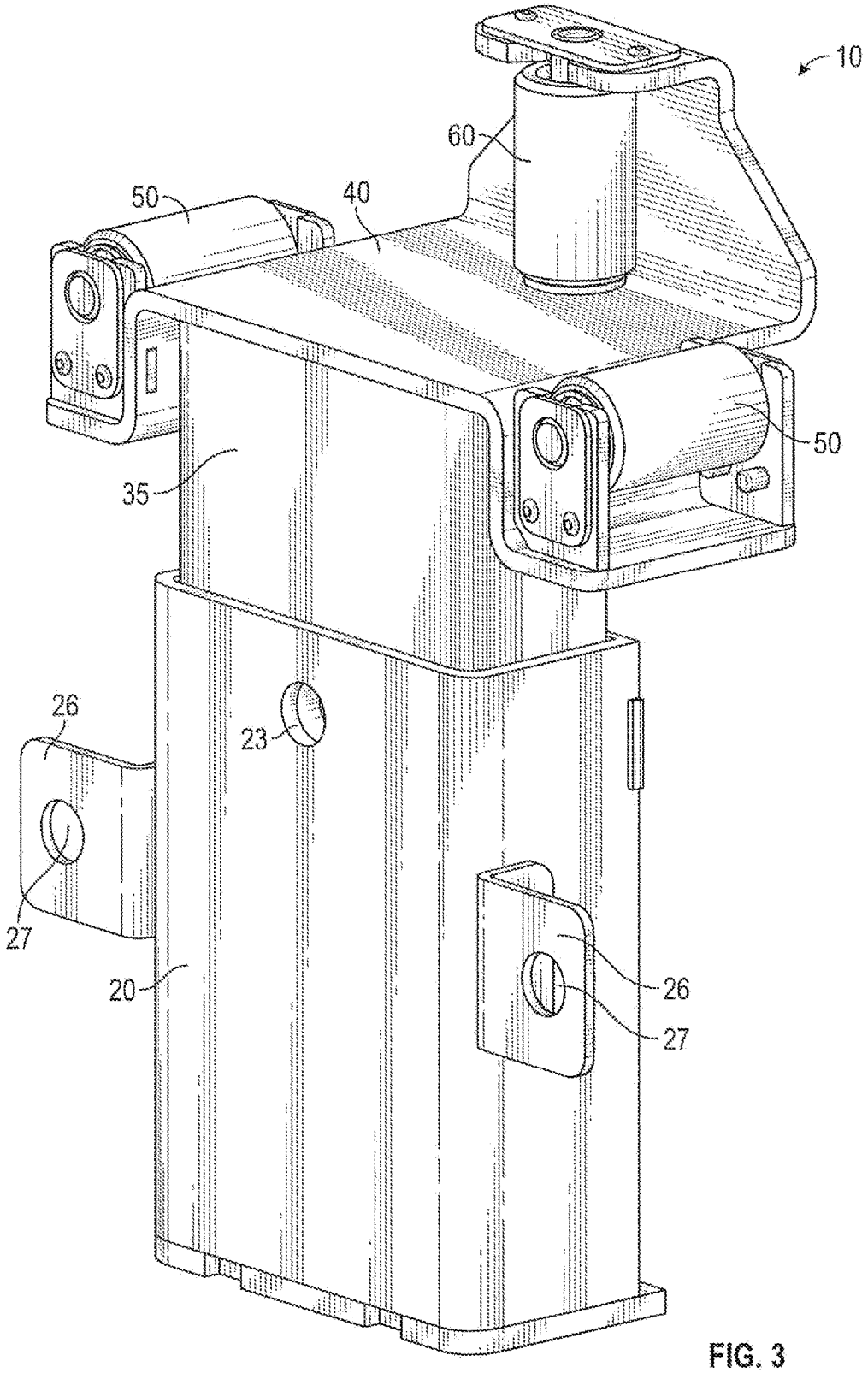
FIG. 3 is front perspective view from the upper front left of the presently preferred embodiment of the roller bracket of the present invention in the raised position.

Referring to FIG. 3, shown is a perspective view from the upper front left of the presently preferred embodiment of the present invention in the raised position, showing the vertical roller 60 rollably mounted on the platform 40.

Figure 4:
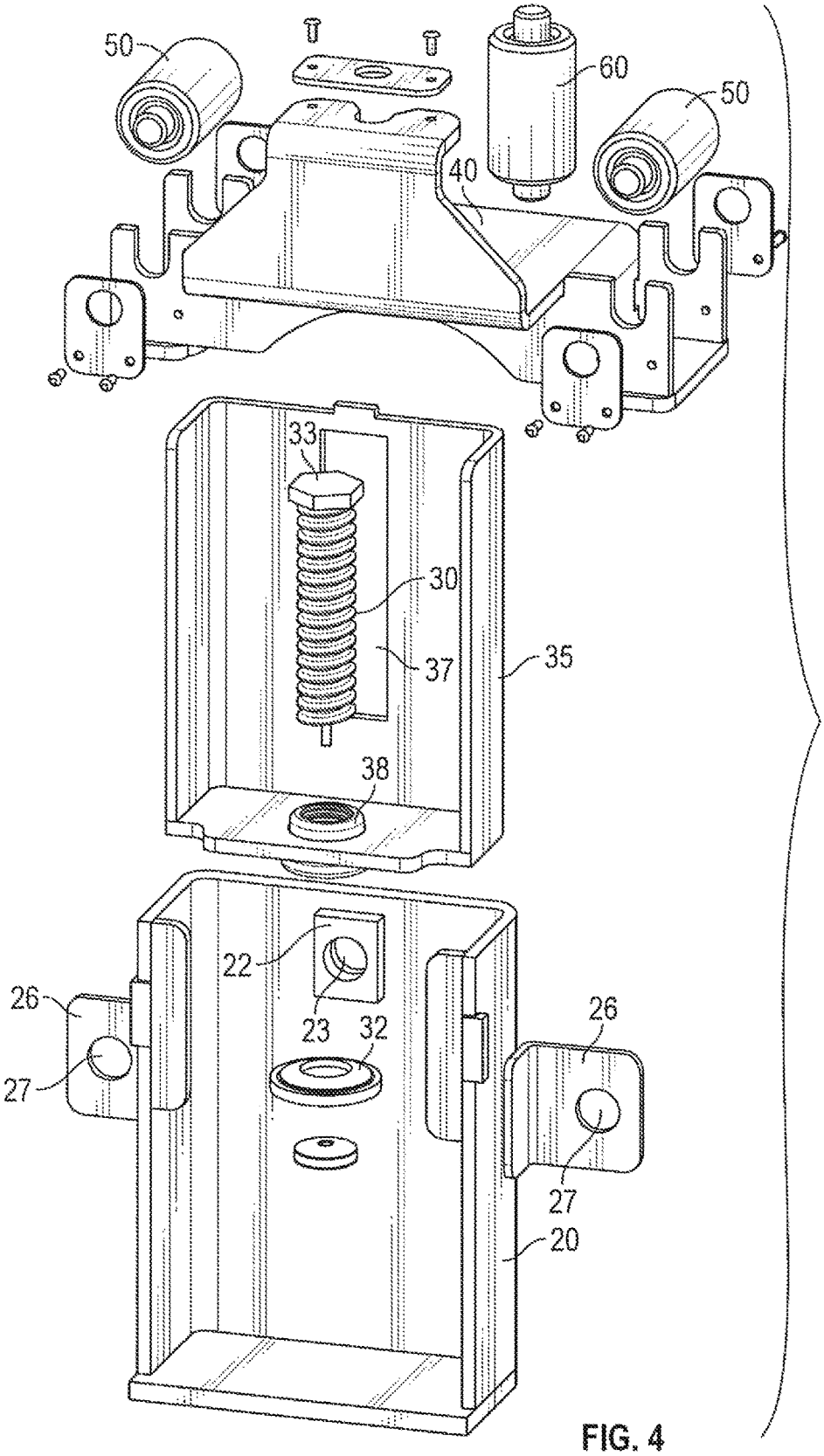
FIG. 4 is an exploded perspective view from the upper rear right of the presently preferred embodiment of the roller bracket of the present invention.

Referring to FIG. 4, shown is an exploded perspective view from the upper rear right of the presently preferred embodiment. As can be seen, platform 40 is supported by the raising and lowering mechanism comprising the threaded bolt 30 rotatably mounted on bearing 32, supporting the carriage 35 through the threaded collar 38.

Figure 5:
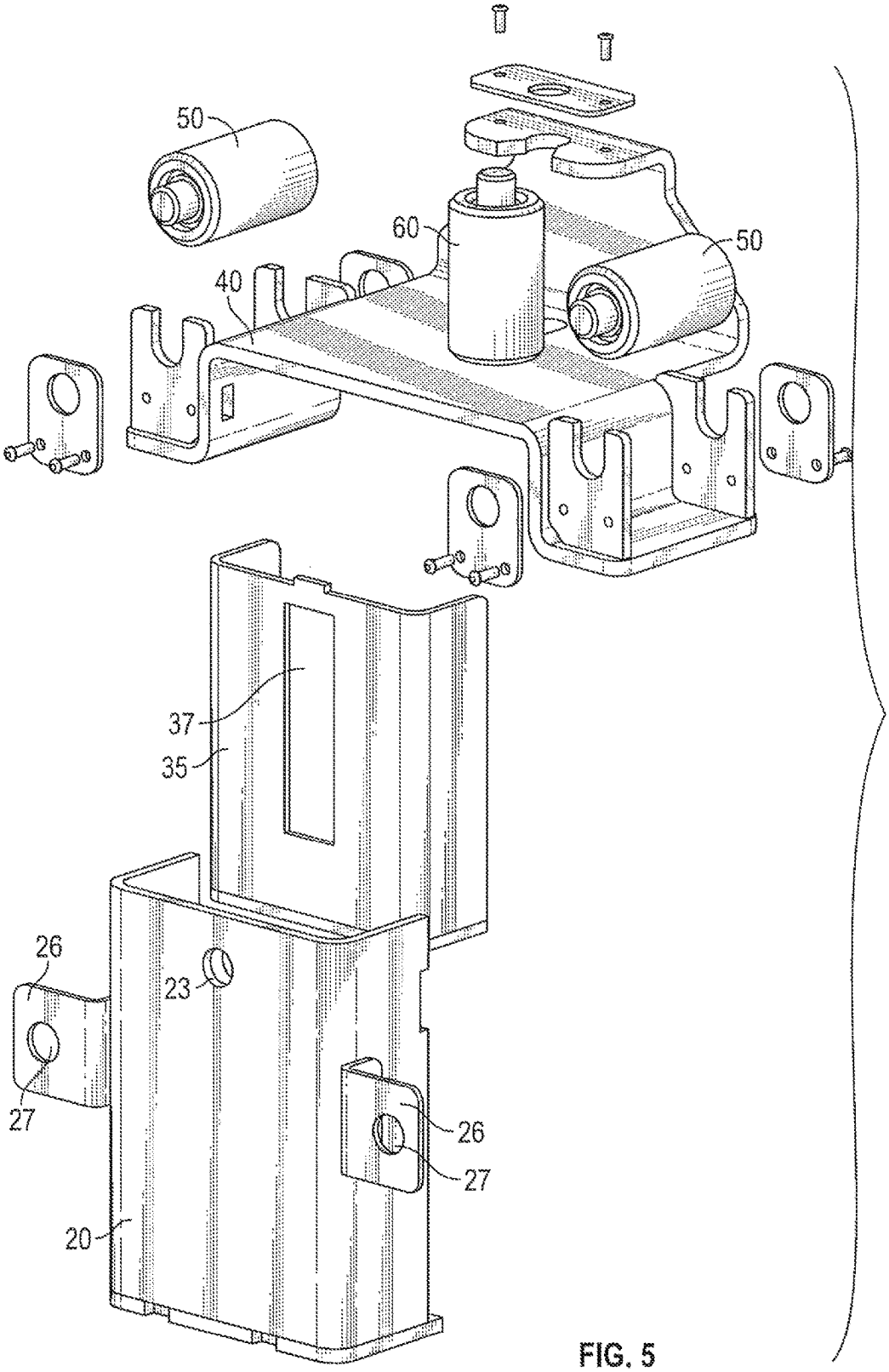
FIG. 5 is an exploded perspective view from the upper front left of the presently preferred embodiment of the roller bracket of the present invention.

Referring to FIG. 5, shown is an exploded perspective view from the upper front left of the presently preferred embodiment.

Figure 6:
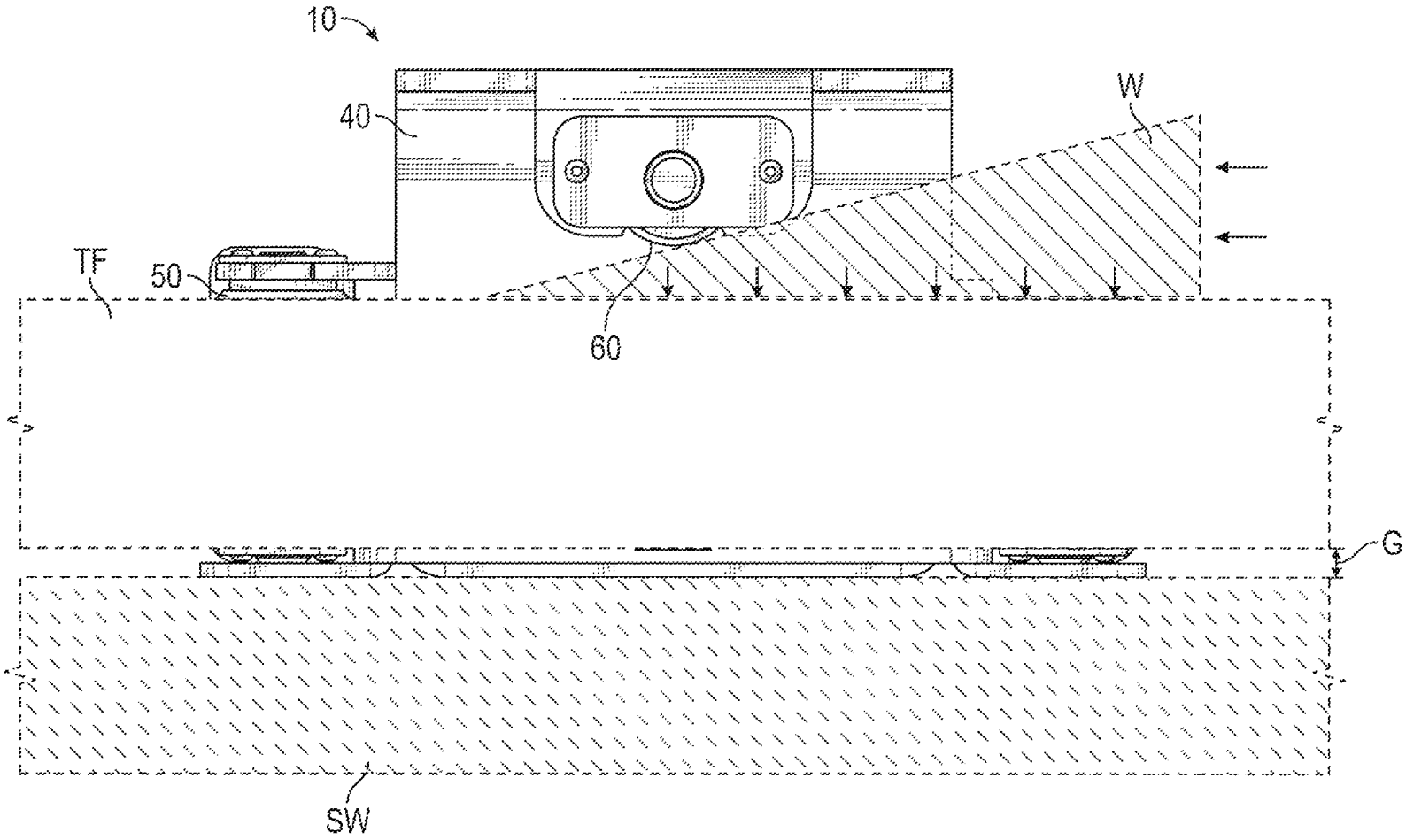
FIG. 6 is a top plan view along the line 6-6 of FIG. 1, before sealing of the tunnel form against the starter wall, and before concrete has been poured.

Referring to FIG. 6, shown is a top elevational view along the lines 6-6 of FIG. 1 (but before sealing of the tunnel form TF against the starter walls SW and before pouring of concrete) of the roller bracket 10 of the present invention, installed on a starter wall SW with a tunnel form TF received and rollably supported on the horizontal rollers 50. As can be seen, a wedge W can be driven from the right between the tunnel form TF and the vertical roller 60, which drives the tunnel form TF towards the starter wall SW, to close the gap G between the starter wall SW and the tunnel form TF, thereby sealing the tunnel form TF to the starter wall SW.

Figure 7:
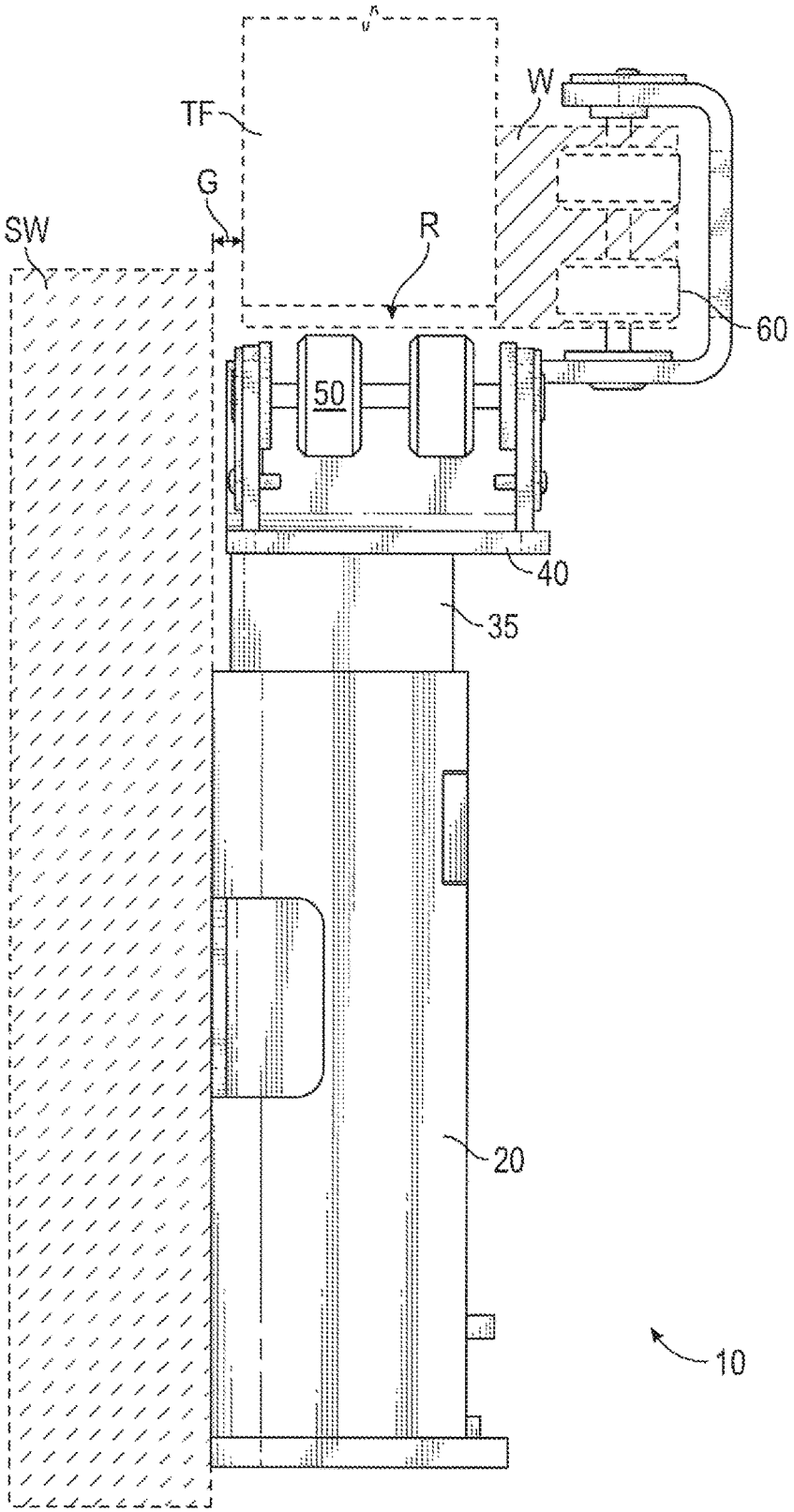
FIG. 7 is an elevational view from the left of the presently preferred embodiment of the roller bracket of the present invention, shown as installed on a starter wall, before sealing of the tunnel form against the starter wall, and before concrete has been poured.

Referring to FIG. 7, shown is a side elevational view from the right of an alternative embodiment of a roller bracket 10

(with multiple coaxial wheels instead of rollers) installed on a starter wall SW with the tunnel form TF having an optional rail R on the bottom edge that is resting on the horizontal wheels 50. As shown in FIG. 6, the wedge W is driven between the vertical wheels 60 and the tunnel form TF to close the gap G and seal the tunnel form TF against the starter wall SW, so that concrete can be poured and retained between the tunnel form TF and the starter wall SW with minimal leakage.

With the structural features disclosed above, it can easily be seen that the roller bracket 10 can be used by placing the base 20 directly on the floor F, next to the starter wall SW, and being fastened to the starter wall SW by a fastener (screw, bolt or otherwise) through the primary mounting hole 23. Because the roller bracket 10 is resting directly on the floor F, no supplemental mounting is necessary to keep the roller bracket in position when the tunnel form TF is placed on the horizontal rollers 50 and the concrete is poured and cured. However, this limits the height of the ceiling that is formed to the height of the vertical portion of the tunnel form TF.

If it is desired to form a ceiling that has a greater height than the height of the tunnel form TF, then the roller bracket 10 can be mounted on the starter wall SW above the floor F by the necessary distance to raise the ceiling to the desired height. However, because the roller bracket 10 will no longer be resting directly on the floor F, it will be necessary to provide supplemental fasteners that will supplementally support the roller bracket 10 such as through the supplemental mounting holes 27, so that the roller bracket 10 can support the full weight of the tunnel form TF, without resting directly on the floor F.

The roller brackets 10 make it much easier to seal the tunnel forms TF against the starter walls SW by driving the wedges W between the vertical rollers 60 and the tunnel forms TF. Because wooden beams spanning the tunnel forms TF are no longer used, the work environment is safer, and the use of labor is substantially reduced. The roller brackets 10 also relieve some of the strain on the lower row of taper ties, so they fail less often.

Because the tunnel form TF is supported on the roller brackets 10 of the present invention, the tunnel form TF can be very easily stripped (after the concrete has cured) by rotating the hex head 33 of the bolt 30 to lower the platform 40, thereby lowering the horizontal rollers 50, without the need for a crane. After the tunnel forms TF have been stripped, it is very easy to roll them away because they are supported on the horizontal rollers 50, and retained on the horizontal rollers 50 by the vertical rollers 60. This substantially reduces the necessary labor to remove the tunnel forms and avoids the danger of the rollers on the floor that are used in conventional removing of the tunnel forms.

It will be apparent to those skilled in the art that various modifications and variations can be made to the presently preferred embodiments disclosed herein, without departing from the spirit and scope of the invention. For example, the rollers can be replaced with multiple coaxial wheels. Accordingly, no limitations are to be implied or inferred in this invention except as specifically and explicitly set forth in the attached claims, and this patent covers all such modifications and variations that come within the scope of the attached claims and their equivalents.

INDUSTRIAL APPLICABILITY

The present invention can be used wherever it is desired to use tunnel forms to pour concrete and form tunnels.

What is claimed is:

1. A roller bracket for mounting on a starter wall that has a top and for rollably support a tunnel form having a bottom edge with a bottom edge thickness, the roller bracket comprising:

a base;

a raising and lowering mechanism mounted to the base;

a platform movably supported by the raising and lowering mechanism;

a horizontal roller having an inner end and an outer end separated by more than the bottom edge thickness, the horizontal roller rollably mounted on the platform; and a vertical roller perpendicular to the horizontal roller, the vertial roller rollably mounted on the platform outward from and above the outer end of the horizontal roller;

wherein when the base is attached to the starter wall so that the horizontal roller is horizontal and projects perpendicularly from the starter wall, with the inner end next to the starter wall, and the vertical roller is vertical and above the horizontal roller, the bottom edge is capable of being lowered between the vertical roller and the starter wall onto the horizontal roller, and the raising and lowering mechanism is capable of lowering the platform with respect to the base to lower the tunnel form supported by the horizontal roller;

whereby the tunnel form is capable of being rollably supported by the horizontal roller with the bottom edge retained on the horizontal roller by the vertical roller;

whereby the base is capable of being attached to the starter wall at a desired level to create a concrete wall of a desired height, with the platform in a raised position but the bottom edge rollably supported by the horizontal roller below the top of the starter wall, so that a wedge is capable of being driven between the vertical roller and the tunnel form to create a seal by forcing the bottom edge of the tunnel form against the starter wall;

whereby after concrete has been poured between the tunnel form and the starter wall and retained by the seal and cured to form the concrete wall above the starter wall, the raising and lowering mechanism is capable of lowering the platform from the raised position, to lower the horizontal roller and the tunnel form rollably supported by the horizontal roller; and whereby the tunnel form is cabable of being stripped from the concrete while being supported by the horizontal roller and rolled away on the horizontal roller while the bottom edge is retained on the horizontal roller between the vertical roller and the cured concrete wall.

2. The roller bracket according to claim 1, wherein said platform is attached to a housing slidable within said base that has a mounting hole slot, and wherein said base has a mounting hole in a projection that projects through said slot when said housing is placed within said base and supported by said raising and lowering mechanism, whereby said projection through said slot limits said housing to moving vertically within said base.

3. The roller bracket according to claim 1, wherein at least one of the rollers is at least two coaxial wheels.

4. The roller bracket according to claim 1, wherein said raising and lowering mechanism is a screw driven jack mounted in the base and attached to the platform.

5. A process for forming a concrete wall of a desired height using at least one tunnel form having a bottom edge with a bottom edge thickness, the process comprising:

creating a starter wall having a top that is less than the desired height;

obtaining at least one roller bracket having a base, a raising and lowering mechanism mounted to the base, a platform movably supported by the raising and lowering mechanism, a horizontal roller having an inner end and an outer end separated by more than the bottom edge thickness, the horizontal roller rollably mounted on the platform, and a vertical roller perpendicular to the horizontal roller, the vertical roller rollably mounted on the platform outward from the outer end of the horizontal roller;

using the raising and lowering mechanism to raise the platform with respect to the base to a raised position;

attaching the base of the roller bracket to the starter wall at a desired level to form a concrete wall of the desired height and so that the horizontal roller is horizontal and projects perpendicularly from the starter wall, with the inner end next to the starter wall, and so that the vertical roller is vertical and above the horizontal roller;

lowering the bottom edge between the vertical roller and the starter wall onto the horizontal roller, whereby the tunnel form is rollably supported on the horizontal roller with the bottom edge retained on the horizontal roller by the vertical roller;

driving a wedge between the vertical roller and the tunnel form to create a seal by forcing the bottom edge of the tunnel form against the starter wall;

pouring concrete between the tunnel form and the starter wall, whereby the concrete is retained by the seal and forms the concrete wall of the desired height;

curing the concrete wall;

lowering the platform from the raised position using the raising and lowering mechanism to lower the horizontal roller and the tunnel form, whereby the tunnel form is stripped from the concrete while being supported by the horizontal roller; and rolling the tunnel form away on the horizontal roller while the bottom edge is retained on the horizontal roller between the vertical roller and the cured concrete wall.

6. A process for forming a concrete wall of a desired height using a tunnel form having a bottom edge with a bottom edge thickness, and a roller bracket having a base, a raising and lowering mechanism mounted to the base, a platform movably supported by the raising and lowering mechanism, a horizontal roller having an inner end and an outer end separated by more than the bottom edge thickness, the horizontal roller rollably mounted on the platform, and a vertical roller perpendicular to the horizontal roller, the vertical roller rollably mounted on the platform outward from the outer end of the horizontal roller, the process comprising:

creating a starter wall having a top that is less than the desired height;

using the raising and lowering mechanism to raise the platform with respect to the base to a raised position;

attaching the base of the roller bracket to the starter wall at a desired level to form a concrete wall of the desired height and so that the horizontal roller is horizontal and projects perpendicularly from the starter wall, with the inner end next to the starter wall, and so that the vertical roller is vertical and above the horizontal roller;

lowering the bottom edge between the vertical roller and the starter wall onto the horizontal roller, whereby the tunnel form is rollably supported on the horizontal roller with the bottom edge retained on the horizontal roller by the vertical roller;

driving a wedge between the vertical roller and the tunnel form to create a seal by forcing the bottom edge of the tunnel form against the starter wall;

pouring concrete between the tunnel form and the starter wall, whereby the concrete is retained by the seal and forms the concrete wall of the desired height;

curing the concrete wall;

lowering the platform from the raised position using the raising and lowering mechanism to lower the horizontal roller and the tunnel form, whereby the tunnel form is stripped from the concrete while being supported by the horizontal roller; and rolling the tunnel form away on the horizontal roller while the bottom edge is retained on the horizontal roller between the vertical roller and the cured concrete wall.

* * * * *